US007301287B1

(12) United States Patent
Lu

(10) Patent No.: US 7,301,287 B1
(45) Date of Patent: Nov. 27, 2007

(54) HIGH POWER LIGHT STRING DEVICE

(75) Inventor: Chong Ying Lu, Miao-Li Hsien (TW)

(73) Assignee: Wang Loong Co., Ltd., Miao-Li Hsien (TW)

( * ) Notice: Subject to any disclaimer, the term of this patent is extended or adjusted under 35 U.S.C. 154(b) by 0 days.

(21) Appl. No.: 11/624,233

(22) Filed: Jan. 18, 2007

(51) Int. Cl.
*H05B 37/00* (2006.01)

(52) U.S. Cl. ..... 315/185 R; 315/185 S; 315/51; 362/640; 362/265; 362/800; 362/653

(58) Field of Classification Search ..... 315/185 R, 315/185 S, 51, 169.1, 169.3; 362/226, 227, 362/240, 257, 249, 265, 653, 654, 545, 640, 362/800
See application file for complete search history.

(56) References Cited

U.S. PATENT DOCUMENTS 4,675,575 A * 6/1987 Smith et al. ..... 315/185 S
6,072,280 A * 6/2000 Allen ..... 315/185 S
6,461,019 B1 * 10/2002 Allen ..... 362/249
6,830,358 B2 * 12/2004 Allen ..... 362/640
6,853,151 B2 * 2/2005 Leong et al. ..... 315/185 R
2002/0145392 A1 * 10/2002 Hair et al. ..... 315/185 R
2004/0233668 A1 * 11/2004 Telfer et al. ..... 362/252
2007/0008721 A1 * 1/2007 Peng et al. ..... 362/227

* cited by examiner

*Primary Examiner*—Haissa Philogene
(74) *Attorney, Agent, or Firm*—Ming Chow; Sinorica, LLC

(57) ABSTRACT

A high power light string device comprises a plug with a plug blade set, a tail receptacle, and at least an LED string, wherein a first power adaptor disposed in the plug converts an AC voltage through the plug blade set to a high DC voltage, and a second power adaptor disposed in the tail receptacle converts the AC voltage through the plug blade set to a low DC voltage. Two ends of the LED string are respectively connected to the first and second power adaptors to receive the high and lower DC voltages so that the LED string is turned on to emit light. The power adaptors are directly disposed respectively in the plug and the tail receptacle to simplify the whole light string device so as to enhance the decorating effect of the light string device.

8 Claims, 3 Drawing Sheets

HIGH POWER LIGHT STRING DEVICE

BACKGROUND OF THE INVENTION

1. Field of the Invention

The present invention relates to a high power light string device and, more particularly, to a light string device composed of LEDs.

2. Description of Related Art

Light emitting diodes (LEDs) have the characteristics of small size, low power consumption, long lifetime, fast response, and luminescence. Moreover, LEDs are recycled to meet the requirement of environmental protection, and cause no problem of mercury pollution to the environment as general fluorescent lights. Besides, LEDs are driven by DC power and thus are easily controlled to reduce the complexity in circuit design. Therefore, LEDs have been widely applied in various kinds of electronic products.

As shown in FIG. 1, U.S. Pat. No. 6,830,358 discloses an LED string device 10, which is commonly used as a decoration light string in several situations such as the Christmas to enhance the festive mood. In FIG. 1, the LED string device 10 comprises a plug 12, a power adaptor 14, two LED strings 16 and a tail receptacle 18. The plug 12 is externally connected to the power adaptor 14 to convert an AC voltage to a DC voltage that is sent to the two LED strings 16. The tail receptacle 18 can be plugged by another plug. However, because the power adaptor 14 has a certain volume, the delicacy of the whole LED string device is usually destroyed.

Accordingly, the present invention provides a more perfect light string device to solve the above problems in the prior art.

SUMMARY OF THE INVENTION

An object of the present invention is to provide a high power light string device that two power adaptors are respectively disposed in a plug and a tail receptacle to simplify the whole light string device so as to enhance the decorating effect and prevent from destroying the delicacy of the whole light string device.

Another object of the present invention is to provide a high power light string device, which makes use of a plurality of LEDs to form a light string structure with high efficiency and power saving.

To achieve the above objects, the present invention provides a high power light string device, which comprises a plug, a tail receptacle, and at least an LED string. The plug has a plug blade set and a first power adaptor. The first power adaptor converts an AC voltage through the plug blade set to a high DC voltage. The tail receptacle has a conducting-strip set and a second power adaptor. The second power adaptor converts the AC voltage through the plug blade set to a low DC voltage. One end of the LED string is connected to the first power adaptor to receive the high DC voltage, and the other end of the LED string is connected to the second power adaptor to receive the low DC voltage so that the LED string is turned on to emit light.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Figure 1:
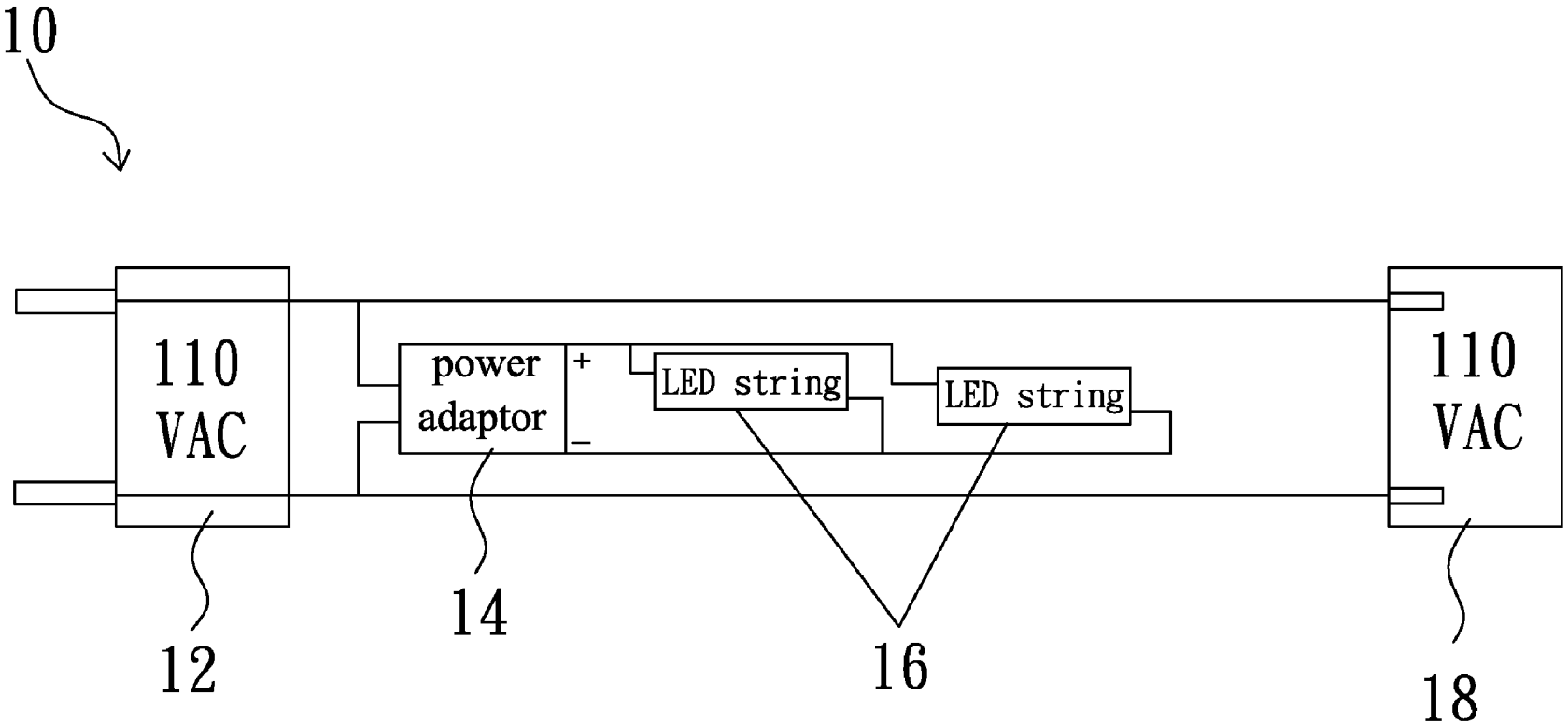
Fig. 1 (Prior Art)
FIG. 1 is a diagram of a conventional LED string device.
Figure 2:
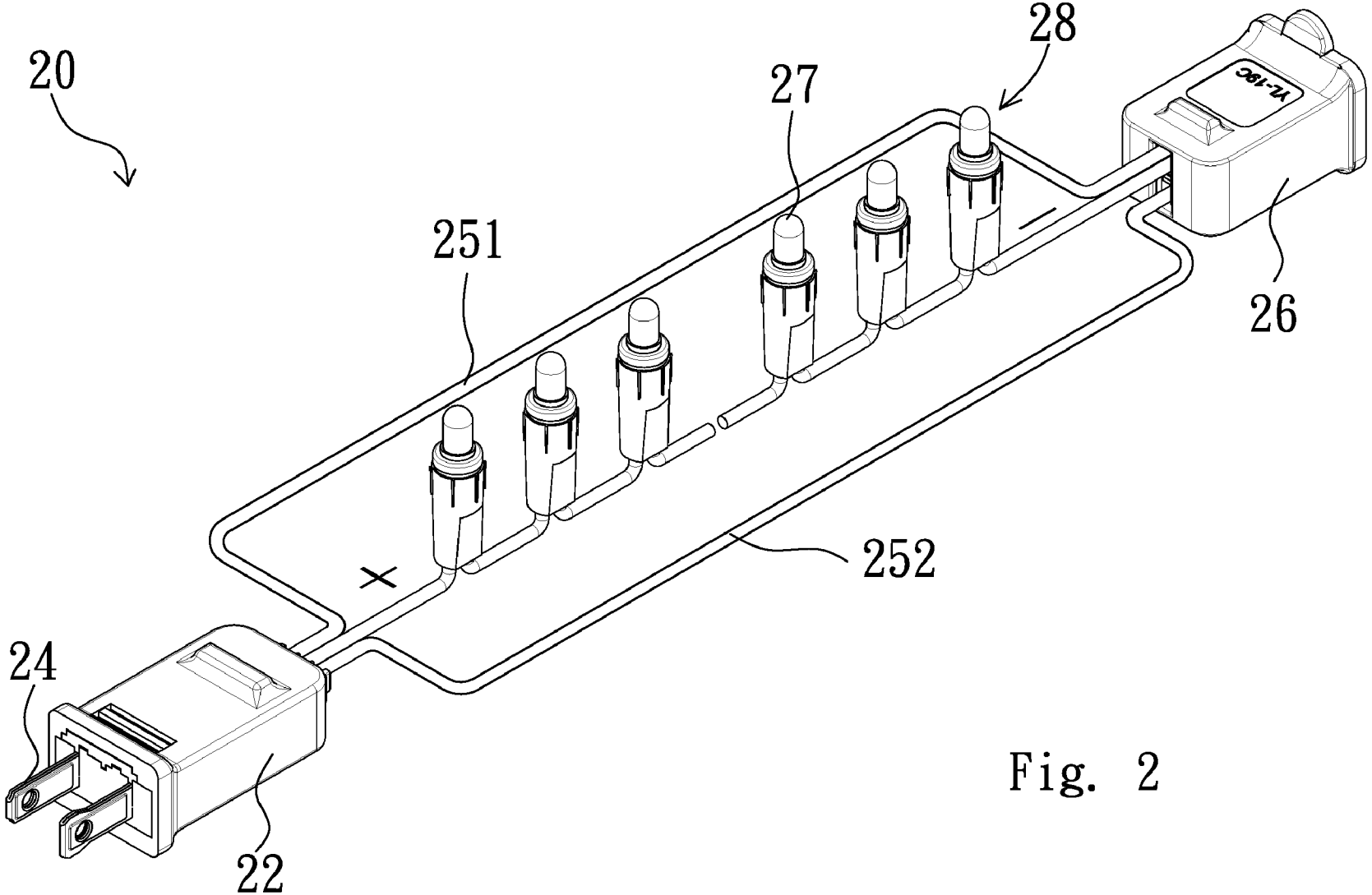
FIG. 2 is a perspective view of the present invention.

A high power light string device 20 in accordance with the present invention is illustrated in FIG. 2. The high power light string device 20 comprises a plug 22, a tail receptacle 26, and an LED string 28. The plug 22 is made of plastic material, and has a plug blade set 24 with two plug blades. The tail receptacle 26 is made of plastic material, and is electrically connected to the plug 22 and the plug blade set 24 via electric wires 251 and 252. The plug 22 and the tail receptacle 26 are driven by the same voltage such as 110 V or 220 V. The LED string 28 is composed of a plurality of LEDs 27. Two ends of the LED string 28 are respectively electrically connected to the plug 22 and the tail receptacle 26.

Figure 3:
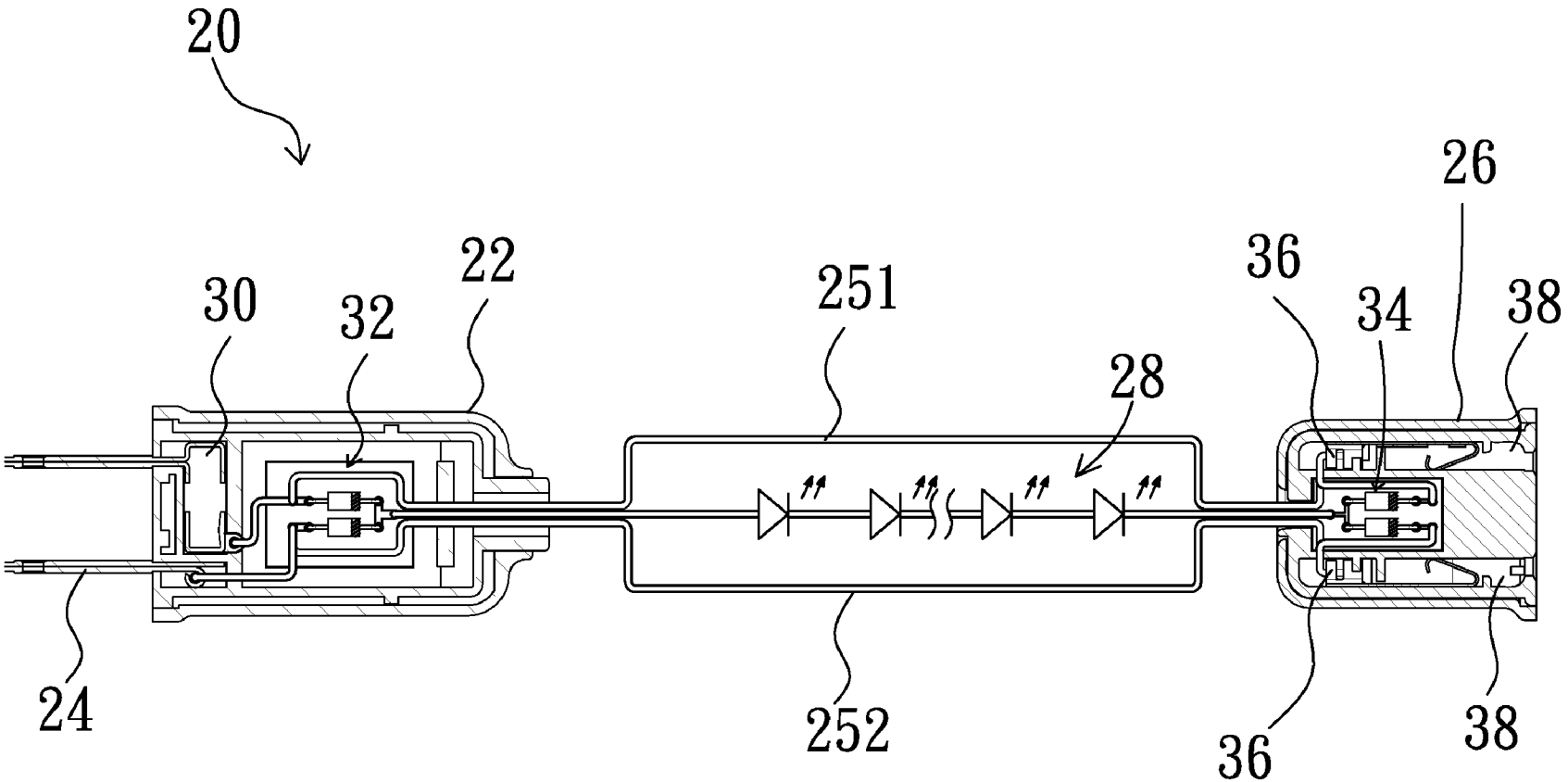
FIG. 3 is an internal structure diagram of the present invention.

As shown in FIG. 3, a fuse component 30 and a power adaptor 32 are disposed in the plug 22. Two ends of the fuse component 30 are respectively electrically connected to the plug blade set 24 and the power adaptor 32 to protect the circuit from the influence of over-current events. The power adaptor 32 converts an AC voltage through the plug blade set 24 to a high DC voltage. Another power adaptor 34 and a conducting-strip set 36 are disposed in the tail receptacle 26. The power adaptor 34 receives the AC voltage, such as 110 V or 220 V, through the plug blade set 24 via the electric wires 251 and 252 to convert this AC voltage to a low DC voltage. The conducting-strip set 36 is electrically connected to the power adaptor 34 and the plug blade set 24. The tail receptacle 26 has two slots 38 so that a plug blade set of a plug of another light string device with the same structure can be inserted therein to achieve electric connection with the conducting-strip set 36. Moreover, one end of the LED string 28 is connected to the power adaptor 32 to receive the high DC voltage, and the other end is connected to the power adaptor 34 to receive the low DC voltage so that the LED string 28 is turned on to emit light. Each LED of the LED string 28 is selected among a white LED, a red LED, a blue LED, a green LED, a yellow LED, or a LED of another color.

To sum up, in the high power light string device of the present invention, two power adaptors are respectively disposed in a plug and a tail receptacle to simplify the whole light string device so as to enhance the decorating effect and prevent from destroying the delicacy of the whole light string device.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A high power light string device comprising:

a plug having a first plug blade set and a first power adaptor, wherein said first power adaptor is disposed in said plug to convert an AC voltage through said first plug blade set to a high DC voltage;

a tail receptacle having a conducting strip set and a second power adaptor disposed interiorly, said second power adaptor converting said AC voltage through said first plug blade set to a low DC voltage; and at least an LED string having a first end and a second end, said first end being connected to said first power adaptor to receive said high DC voltage and said second end being connected to said second power adaptor to receive said low DC voltage so that said LED string is turned on to emit light.

2. The high power light string device as claimed in claim 1, wherein said conducting-strip set is electrically plugged by a second plug blade set of a second plug.

3. The high power light string device as claimed in claim 1, wherein said conducting-strip set is electrically connected to said second power adaptor.

4. The high power light string device as claimed in claim 1, wherein said conducting-strip set is electrically connected to said first plug blade set.

5. The high power light string device as claimed in claim 1, wherein said plug and said tail receptacle are driven at the same voltage.

6. The high power light string device as claimed in claim 1, wherein a fuse component is further disposed in said plug, and said fuse component is electrically connected to said first power adaptor and said first plug blade set.

7. The high power light string device as claimed in claim 1, wherein said plug and said tail receptacle are made of plastic material.

8. The high power light string device as claimed in claim 1, wherein each LED of said LED string is selected among a white LED, a red LED, a blue LED, a green LED, a yellow LED, and a LED of another color.

* * * * *

US007301287C1

(12) EX PARTE REEXAMINATION CERTIFICATE (9073rd)

United States Patent

Lu

(10) Number: US 7,301,287 C1

(45) Certificate Issued: Jun. 12, 2012

(54) HIGH POWER LIGHT STRING DEVICE

(75) Inventor: Chong Ying Lu, Miao-Li Hsien (TW)

(73) Assignee: Chao Tai Electron Co. Ltd., Kaohsiung (TW)

Reexamination Request:
No. 90/011,711, Jun. 27, 2011

Reexamination Certificate for:

| | |
|---|---|
| Patent No.: | **7,301,287** |
| Issued: | **Nov. 27, 2007** |
| Appl. No.: | **11/624,233** |
| Filed: | **Jan. 18, 2007** |

(51) Int. Cl.

| | |
|---|---|
| ***H05B 37/00*** | (2006.01) |
| ***H05B 39/00*** | (2006.01) |
| ***H05B 41/00*** | (2006.01) |

(52) U.S. Cl. ..... 315/185 R; 315/51; 362/640; 362/265; 362/800; 362/653

(58) Field of Classification Search ..... None
See application file for complete search history.

(56) References Cited

To view the complete listing of prior art documents cited during the proceeding for Reexamination Control Number 90/011,711, please refer to the USPTO's public Patent Application Information Retrieval (PAIR) system under the Display References tab.

*Primary Examiner*—John Heyman

(57) ABSTRACT

A high power light string device comprises a plug with a plug blade set, a tail receptacle, and at least an LED string, wherein a first power adaptor disposed in the plug converts an AC voltage through the plug blade set to a high DC voltage, and a second power adaptor disposed in the tail receptacle converts the AC voltage through the plug blade set to a low DC voltage. Two ends of the LED string are respectively connected to the first and second power adaptors to receive the high and lower DC voltages so that the LED string is turned on to emit light. The power adaptors are directly disposed respectively in the plug and the tail receptacle to simplify the whole light string device so as to enhance the decorating effect of the light string device.

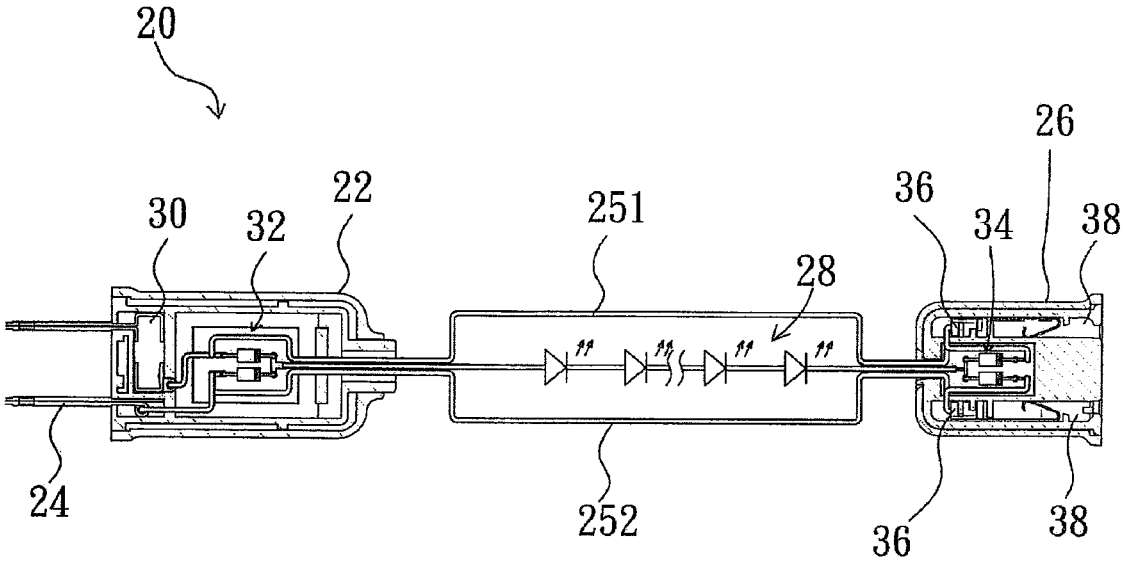

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-8 is confirmed.

* * * * *